US005630230A

United States Patent [19]

Fujino et al.

[11] Patent Number: 5,630,230

[45] Date of Patent: May 20, 1997

[54] COOLING CAP ELEMENT

[75] Inventors: Yukio Fujino; Yuuichi Matsuura, both of Tokyo, Japan

[73] Assignee: Kure Grinding Wheel Co., Ltd., Hiroshima-ken, Japan

[21] Appl. No.: 477,746

[22] Filed: Jun. 7, 1995

[30] Foreign Application Priority Data

Jun. 20, 1994 [JP] Japan ..... 6-008389 U

[51] Int. Cl.[6] ..... A42B 1/00

[52] U.S. Cl. ..... 2/200.1; 2/7; 2/901

[58] Field of Search ..... 2/200.1, 171.2, 2/181, 181.6, 182.3, 182.8, 183, 209.5, 195.2, 901, DIG. 11, 7, 209.13

[56] References Cited

U.S. PATENT DOCUMENTS

| | | | |
|---|---|---|---|
| 2,263,395 | 11/1941 | Page | 2/181 |
| 2,696,618 | 12/1954 | Hoffman et al. | 2/181 |
| 2,769,308 | 11/1956 | Krasno | 2/171.2 |
| 2,832,077 | 4/1958 | McGinnis | 2/7 |
| 2,875,447 | 3/1959 | Goldmerstein | 2/171.2 |
| 3,029,438 | 4/1962 | Henschel | 2/7 |
| 4,130,902 | 12/1978 | Mackenroth, III et al. | 2/171.2 |
| 4,742,581 | 5/1988 | Rosenthal | 2/200.1 |
| 4,815,144 | 3/1989 | Martin | 2/7 |
| 4,856,116 | 8/1989 | Sullivan | 2/181 |
| 5,025,504 | 6/1991 | Benston et al. | 2/183 |
| 5,157,788 | 10/1992 | Schultz | 2/7 |
| 5,327,585 | 7/1994 | Karlan | 2/7 |
| 5,453,268 | 9/1995 | Ueno et al. | 424/76.8 |
| 5,464,695 | 11/1995 | Kawamoto et al. | 428/370 |
| 5,471,683 | 12/1995 | Moretz et al. | 2/181 |

*Primary Examiner*—Michael A. Neas
*Attorney, Agent, or Firm*—Loeb & Loeb LLP

[57] ABSTRACT

A cap element mainly composed of a three-layer fabric, the three-layer fabric member including: a mesh-like front surface fabric; a waterproof back surface fabric; and a non-woven fabric formed of water absorptive high molecular fibers, which is sealed between the front surface fabric and the back surface fabric. At least one of the front surface fabric and the back surface fabric may be subjected to ultraviolet ray shielding treatment, or composed of a knitted or woven fabric formed of fibers of a high molecular polymer containing an inorganic material capable of absorbing ultraviolet rays and reflecting the heat rays of the sun.

5 Claims, 2 Drawing Sheets

COOLING CAP ELEMENT

BACKGROUND OF THE INVENTION

1. Field of the Invention

The present invention relates to a cooling cap element used as a hair band attached to a head portion and a cap for preventing the rays of the sun in hot outdoors or for performing works comfortably and safely in a high temperature/high heat work field, or used as an inner cap attached inside a helmet.

2. Prior Art

In a welding work field applied with high heat; a high temperature work field for iron-making, casting or power equipment construction; an outdoor work field under the blazing sun for fork lift work, civil engineering work or agricultural work; or outdoor sports, hiking and sport watching, to suppress sweating, a towel dipped with water has been attached on a head portion or a sweating preventive material has been attached in the cap. In an environment at a temperature of 30° C. or more, however, the towel containing water generally loses the cooling effect for a short period of time, for example, from 5 to 10 min. Moreover, such a towel is undesirable in terms of appearance and safety.

In the case where a strong cooling effect has been required, a band-like bag enclosing a gel-like cooling agent has been sometimes used. It is frozen in a refrigerator before being attached to a head portion. In this cap element, however, the sustained time of the cooling agent is restrictive, and the cooling agent must be frozen again for re-use. Accordingly, in the outdoors with no refrigerator, such a cooling agent cannot be actually re-used, and even when being frozen, it takes a lot of time to freeze the cooling agent, and thereby the cap element cannot be immediately re-used.

SUMMARY OF THE INVENTION

In view of the foregoing, the present invention has been made, and an object of the present invention is to provide a cooling cap element capable of keeping a cooling effect for a relatively long period of time, and of easily re-using it even in the outdoors, and also having a suitable form in terms of appearance and safety.

The cap element of the present invention is mainly composed of a three-layer fabric member, the three-layer fabric member including: a mesh-like front surface fabric; a waterproof back surface fabric; and a non-woven fabric formed of water absorptive high molecular fibers, which is sealed between the front surface fabric and the back surface fabric. The cap element may further include a peripheral length adjusting means. At least one of the front surface fabric and the back surface fabric is preferably subjected to ultraviolet ray shielding treatment, or composed of a knitted or woven fabric formed of fibers of a high molecular polymer containing an inorganic material capable of absorbing ultraviolet rays and reflecting the heat rays of the sun. An antibacterial agent may be mixed in the fibers forming the non-woven fabric, and a plurality of ventilation holes may be formed in the three-layer fabric member.

When the cooling cap element is dipped in water, water permeates in the three-layer fabric member from the mesh-like front surface fabric, and is absorbed in the non-woven fabric. By putting the cooling cap element thus containing water on a head portion, the heat from the exterior and the head portion is gently evaporated. At this time, by the release of the heat of evaporation, the cooling cap element and the head portion contacted therewith are cooled. The cooling effect is continued for a long period of time.

The cap element can be closely contacted with the surface of the head portion by adjusting the peripheral length of the cap element using the peripheral length adjusting means, thus positively exerting the cooling effect on the head portion. The front surface fabric and the back surface fabric subjected to ultraviolet ray shielding treatment is able to suppress a temperature rise of the cap element. In addition, the antibacterial agent mixed in the fibers of the non-woven fabric is effective to block the generation and the propagation of mold due to the water content remaining in the cap element when the cap element is dried and stored. In addition, the vapor remaining in the cap element during use can be removed to the outside through a plurality of the ventilation holes formed in the three-layer fabric member.

DETAILED DESCRIPTION OF PREFERRED EMBODIMENT

Figure 1:
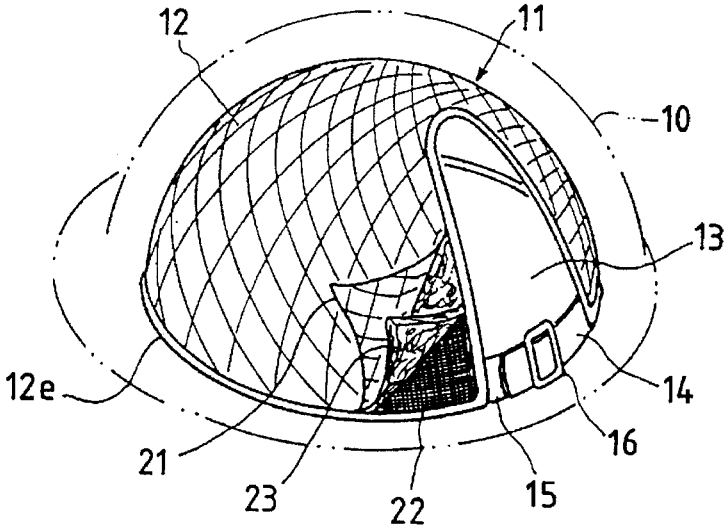
FIG. 1 is a perspective view of a cooling cap element according to an embodiment of the present invention, with parts being partly cut-away.
Figure 2:
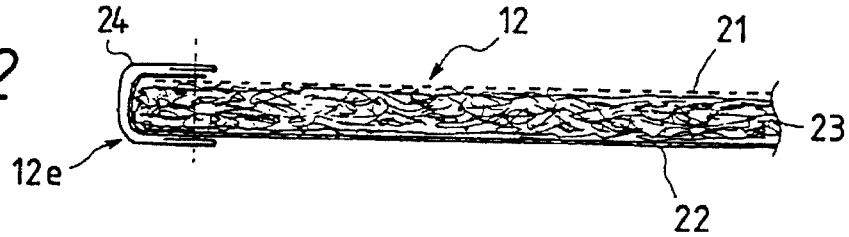
FIG. 2 is an enlarged sectional view of a three-layer fabric member.

FIG. 1 shows one embodiment wherein a cooling cap element 11 of the present invention is applied to an inner cap attached inside a helmet 10 or the like. In the figure, the cooling cap element 11 is prepared by sewing a three-layer fabric member 12 having a water absorptive non-woven fabric 23 sealed between a mesh-like front surface fabric 21 and a waterproof back surface fabric 22. FIG. 2 is an enlarged sectional view of the three-layer fabric member 12.

As the mesh-like front surface fabric 21, a fabric having a large mesh size and being excellent in ventilation and water permeability such as a raschel fabric or leno fabric made of cotton, jute, nylon or polyester is suitable for obtaining an excellent cooling effect. A further excellent cooling effect can be obtained using a knitted fabric or woven fabric made of polyester mixed with special ceramics excellent in the function of absorbing ultraviolet rays in the sunlight and reflecting the heat rays of the sun.

As the waterproof back surface fabric 22, a fabric excellent in waterproof and water repellency is used for preventing the leakage of water contained in the non-woven fabric 23. For example, there is used a waterproof fabric obtained by forming a waterproof film on a knitted or woven fabric made of nylon, polyester, blend of polyester/cotton or the like by a single side coating method, and surface-treating the waterproof film using a silicon or fluorine water repellency agent. As the coating agent, amino resin, polyurethane or self-crosslinking acrylic resin is preferably used.

The water absorptive non-woven fabric 23 is prepared by opening staples of acrylic resin coated on the surface layer with a high molecular gel material by carding, and forming a web therefrom in a common non-woven fabric manufacturing process. In the web thus obtained, staples are preferably entangled with each other by a needling machine. The amount of the water absorption is preferably about 5 to 8 times of the empty weight of the non-woven fabric 23. To control the amount of the water absorption, the non-woven fabric 23 may be blended with synthetic fibers of such as polyester, acrylic resin or polyester, or may be blended with natural fibers such as sheep wool, cotton or jute in an amount of from 10 to 50%. The Metsuke (weight per unit square) of the web is adjusted in the range of from 30 to 200 g/cm$^2$.

The staples of acrylic resin, which is covered on the surface layer with a high molecular gel used for the water absorptive non-woven fabric 23 can absorb a large amount of water, be difficult to release water even by applying a relatively large pressure, and thereby it can keep the cooling effect for a long period of time; however, it is low in the evaporation rate of the water content contained between molecules. To increase the evaporation rate, the non-woven fabric may be mixed with 30% of far-infrared radiation fibers for accelerating the cooling effect due to the heat of evaporation.

As the far-infrared radiation fibers, synthetic fibers of a high molecular polymer mixed with fine powder ceramics such as alumina, silica or zirconium carbonate. Moreover, it may be further mixed with cotton fibers to increase the surface area for effectively accelerating the evaporation.

The high molecular gel covering the surface of the staples of acrylic resin used for the water absorptive non-woven fabric 23 is changed in the form of solid phase-liquid phase-solid phase according to the water containing state, so that in the drying state, the cooling cap element 11 can be used as a common inner cap. Consequently, the cooling cap element 11 can be used throughout all the seasons, that is, it is used for sweating prevention in summer and is used for cold protection in winter.

The cooling cap element 11 is dried upon storage, and at this time, there is a fear that the cooling cap element is covered with mold when water content remains. To keep the cooling cap element from getting moldy, a fibrous antibacterial agent may be mixed in an amount of from 10 to 50%.

When the cooling cap element 11 is formed by sewing the three-layer fabric member 12 having the above-described composition, as shown in FIG. 2, the waterproof back surface fabric 22 is folded at edge portions (in particular, the lower end portion) 12*e* of the three-layer fabric member 12 for covering the water absorptive non-woven fabric 23, and is bound or hemmed using a tape 24 for preventing the flow-out of water content absorbed in the water absorptive non-woven fabric 23.

The cooling cap element 11 can be increased in its cooling effect when it is closely contacted with the surface of a head portion. For this reason, a cutout portion 13 is formed in a portion of the peripheral edge as shown in FIG. 1, and both the sides of the cutout portion 13 are connected to each other by means of belts 14 and 15, and a buckle 16, thus making it possible to adjust the peripheral length.

When being used, the cooling cap element 11 having the above construction is dipped in water. Water permeates the three-layer fabric member 12 through the mesh-like front surface fabric 21, and is absorbed in the water absorptive non-woven fabric 23. The water absorptive non-woven fabric 23 containing water is swelled to be 5 to 8 times the empty weight of the non-woven fabric 23.

When the cooling cap element 11 containing water is put on a head portion as the inner cap of a helmet 10, the water content contained in the water absorptive non-woven fabric 23 is gently evaporated by the heat from the exterior and the head portion, and by the release of the heat of evaporation, the cooling cap element 11 and the head portion contacted with the cap element 11 are cooled.

At this time, since the mesh-like front surface fabric 21 is excellent in ventilation, the evaporation of the water content is accelerated, thus rapidly achieving the cooling effect. In addition, the head portion is prevented from being wetted by the water absorbed in the water absorptive non-woven fabric 23, thereby ensuring the comfortable feeling.

Figure 3:
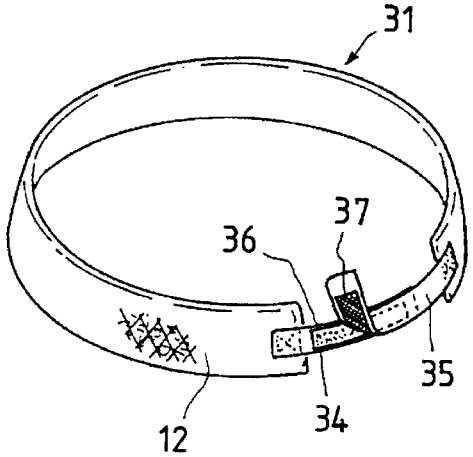
FIG. 3 is a perspective view of another embodiment of the present invention.

FIG. 3 shows a cooling cap element 31 of the present invention applied to a band-like inner cap. In the cooling cap element 31, the end portions of a band-like three-layer fabric member 12 are connected to each other by means of belts 34, 35 and fastener 36, 37, thus making it possible to adjust the peripheral length. In addition, as the peripheral length adjusting means, an expandable band such as a rubber band may be used.

The cooling cap element of the present invention is applicable as the above-described inner cap of a helmet used in a high temperature/high heat work field, and further it is variously used in works, sports or plays for leisure at a high temperature for preventing a temperature rise of a head portion, thus making comfortable these activities. Hereinafter, each embodiment will be described with reference to the drawings.

Figure 4:
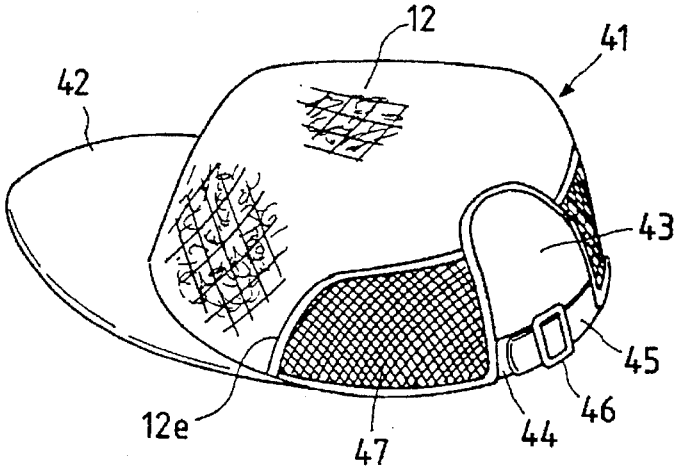
FIG. 4 is a perspective view of a further embodiment of the present invention.

A cooling cap element 41 shown in FIG. 4, which is obtained by sewing a three-layer fabric member 12, is applied to a common cap. Both the sides of a cutout portion 43 at the rear head portion are connected to each other by means of belts 44, 45 and a buckle 46, thereby adjusting the peripheral length. A side head portion 47 is formed of a mesh single layer for ensuring ventilation, thus preventing the steaming of the head portion. A visor 42 is made of synthetic resin, and is thus prevented from being deteriorated due to the dipping in water.

Figure 5:
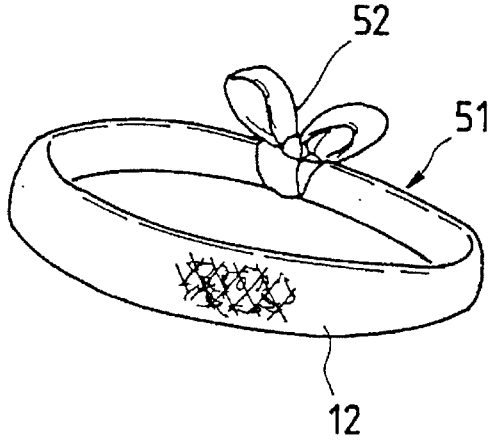
FIG. 5 is a perspective view of a further embodiment of the present invention.
Figure 6:
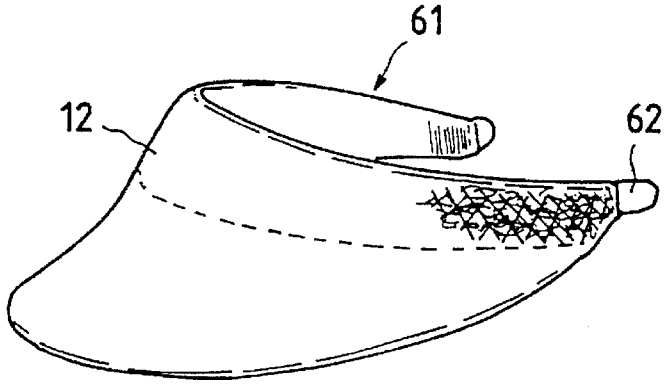
FIG. 6 is a perspective view of a further embodiment of the present invention.

A cooling cap element 51 shown in FIG. 5 is a hair band composed of a band-like three-layer fabric member 12, which can be adjusted in its peripheral length by means of a knit 52. A cooling cap element 61 shown in FIG. 6 is a hair cap (sun visor), in which a horseshoe shaped elastic body 62 is provided so as to pass through a three-layer fabric member 12. The horseshoe shaped elastic body 62 can be fixed around the head portion, and allows the three-layer fabric member 12 to be closely contacted with the front head portion.

Figure 7:
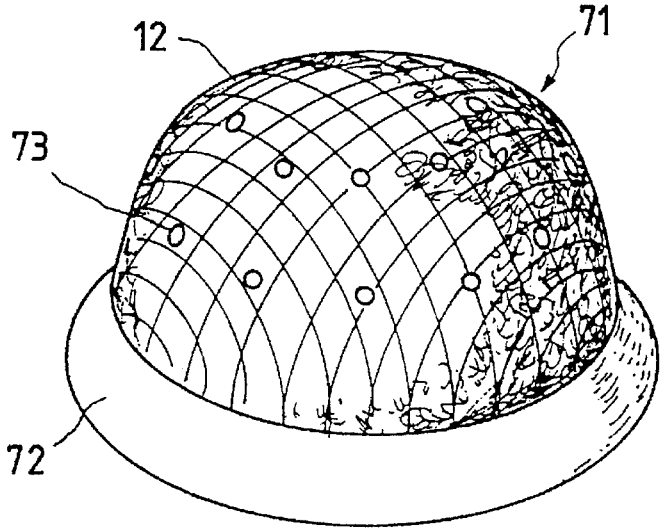
FIG. 7 is a perspective view of a further embodiment of the present invention.

A cooling cap element 71 shown in FIG. 7 is so constructed that the whole crown is formed of a three-layer fabric member 12, and a brim 72 is made of a common material. A number of ventilation holes 73 are formed in the three-layer fabric member 12 for releasing the vapor remaining in the interior to the outside, which is effective to obtain comfortable feeling.

The three-layer fabric member 12 as the main material of each of the above-described cooling cap elements 11, 31, 41, 51, 61 and 71 is composed of only a fiber material, so that the feeling is soft and light, and the appearance is not different from that of a common cap element.

The cooling cap element having the above-described construction has the following effects:

The cooling cap element of the present invention is mainly composed of a three-layer fabric member including a mesh-like front surface fabric, a waterproof back surface fabric, and a non-woven fabric made of water absorptive high molecular fibers which is sealed therebetween, and accordingly, a large amount of water content can be held in the water absorptive non-woven fabric only by dipping the cooling cap element before use; and an excellent cooling effect can be obtained due to the gentle evaporation of the water content and the release of the evaporation, thereby making it possible to safely and comfortably perform works in a high temperature/high heat work field, and outdoor works, sports and plays for leisure at a high temperature. Moreover, since the three-layer fabric member as the main material of the cooling cap element is made of only fibers, it is easily sewn with a common cap in a suitable form in terms of appearance and safety.

Since the above-described cap element includes a peripheral length adjusting means, it can be closely contacted with a head portion, thus obtaining an excellent cooling effect relative to the head portion.

Since at least one of the mesh-like front surface fabric and the waterproof back surface fabric is subjected to ultraviolet ray treatment or composed of a knitted or woven fibers formed of a high molecular polymer mixed with an inorganic material capable of absorbing ultraviolet rays and reflecting the rays of the sun, it becomes possible to suppress a temperature rise of the cap element due to ultraviolet rays and heat rays of the sun, thus evaporating the water content mainly by the heat from the head portion, and enhancing the cooling effect to the head portion.

Since an antibacterial agent is mixed in fibers forming the non-woven fabric, it becomes possible to prevent the generation and propagation of mold during dry storage or the like, and to repeatedly use the cap element in a clean state. The cap element is suitably used as a common cap element in a drying state even in the times and environments not requiring the cooling. In addition, since the ventilation holes are formed in the three-layer fabric, the vapor remaining in the cap element during use can be removed to the outside, thus ensuring the comfortable feeling.

What is claimed is:

1. A cooling cap comprising a three-layer fabric member forming a cap body for covering a head, a peripheral length adjusting means connected to the three-layer fabric member for surrounding the head, the three-layer fabric member having a plurality of ventilation holes formed therein, the three-layer fabric member comprising:

a mesh-like first surface fabric, a waterproof second surface fabric, and a non-woven fabric sealed between the first surface fabric and the second surface fabric, the non-woven fabric comprising water absorptive high molecular fibers comprising acrylic resin staples having a surface layer coated with a high molecular gel material.

2. The cooling cap of claim 1, wherein at least one of the first surface fabric and the second surface fabric is subjected to ultraviolet ray shielding treatment.

3. The cooling cap of claim 1, wherein at least one of the first surface fabric and the second surface fabric comprises at least one of a knitted fabric and a woven fabric formed of fibers of a high molecular polymer containing an inorganic material capable of absorbing ultraviolet rays and reflecting the heat rays of the sun.

4. The cooling cap of claim 1, wherein the non-woven fabric contains about 30% far-infrared radiation fibers.

5. The cooling cap of claim 1, wherein an antibacterial agent is mixed in the fibers forming the non-woven fabric.

* * * * *